United States Patent [19]

Winrow et al.

[11] Patent Number: 4,566,210

[45] Date of Patent: Jan. 28, 1986

[54] DISPLAY DEVICE

[75] Inventors: Donald Winrow, Weston; Kenneth G. Copeland, Oakville, both of Canada

[73] Assignee: Nei Canada Limited, Toronto, Canada

[21] Appl. No.: 503,515

[22] Filed: Jun. 13, 1983

[51] Int. Cl.[4] ..... G09F 9/00

[52] U.S. Cl. ..... 40/449; 340/815.24; 340/815.26

[58] Field of Search ..... 40/449, 463; 340/815.26, 815.24, 815.29

[56] References Cited

U.S. PATENT DOCUMENTS

| | | | |
|---|---|---|---|
| 513,775 | 1/1894 | Garl | 340/815.29 |
| 3,469,258 | 9/1969 | Winrow | 40/449 |
| 3,537,197 | 11/1970 | Smith | 40/449 |
| 3,553,619 | 1/1971 | Skrobisch | 340/815.26 |
| 3,560,956 | 2/1971 | Sinnott | 340/815.24 |
| 3,886,545 | 5/1975 | Skrobisch | 340/815.26 |
| 3,935,571 | 1/1976 | Sargent | 340/815.24 |
| 3,936,818 | 2/1976 | Skrobisch | 340/815.26 |
| 3,975,728 | 8/1976 | Winrow | 340/815.26 |
| 4,117,478 | 9/1978 | Skrobisch | 340/815.24 |
| 4,223,464 | 9/1980 | Winrow | 40/449 |
| 4,308,528 | 12/1981 | Hummel et al. | 40/449 |
| 4,327,357 | 4/1982 | Skrobisch | 340/815.29 |
| 4,394,652 | 7/1983 | Rabette | 40/449 |

*Primary Examiner*—Gene Mancene
*Assistant Examiner*—James Hakomaki
*Attorney, Agent, or Firm*—Harold H. Dutton, Jr.; Robert L. Westell

[57] ABSTRACT

A display device has lever mounted display members with their members on one end movable from exposed to eclipsed position to provide a variable display and permanent magnets on the other end to provide for control of the lever by magnetizable cores located rearwardly thereof. A housing structure accurately mounts both a frame which holds the levers and a rear face which holds the cores in three dimensions contributing to the precision of the magnetic control. The cores are mounted projecting from the rear wall of the housing. The forward ends of the cores may be accurately located again contributing to the precision of the magnetic control. The improvement of the magnetic coil means the energizing coils for the windings must be made smaller and for this and other reasons the device may be made smaller from front to back.

3 Claims, 5 Drawing Figures

DISPLAY DEVICE

This invention relates to lever operated display or indicating devices.

The invention represents an improvement upon the devices disclosed in U.S. Pat. No. 3,537,197 dated Nov. 3rd, 1970. Both this invention and the patented device relate to devices where one or more pivotted levers each carry display blades projecting from the end of the lever roughly transversely to the radius from the pivot axis. A permanent magnet is mounted on each lever on the side of the pivot point remote from the blade and one pole of a reversibly permanently magnetizable (high remanence) magnetic core (having an energizing coil wound thereon) is located adjacent the permanent magnet locus to control, by its sense of magnetization, the positioning of the lever in one of two limiting positions. (Movement of the permanent magnet between said limiting positions defines the 'locus of the permanent magnet' referred to hereafter). The visible surface of each blade is coloured to contrast with the background and the housing for the lever assembly is designed so that, for each lever, the blade in one limiting position is exposed in the viewing direction and in the other limiting position, the blade is eclipsed or hidden from the viewer by a stationery portion of the housing. The contrasting surface of the blades may be of various shapes in the viewing direction but usually take the form of bars. The most common application of the invention, both as shown in U.S. Pat. No. 3,537,197 and as disclosed herein is thought to be the use of seven levers each with bar shaped blades arranged in the well known FIG. 8 arrangement where, by proper selection of the combinations of blades to be displayed, any of the digits 0 to 9 may be indicated.

It is an object of one facet of this invention to provide a device of the type described in the previous paragraph a housing mounting such actuable levers which is more compact than previously available. Such compactness is provided by mounting the pivotally actuable levers in a housing having an apertured front wall, side walls and a rear wall closing to a large degree the rear of the housing. The cores are mounted on the rear wall to project rearwardly therefrom and the energizing coils are mounted on the cores rearwardly of the rear wall. The result is a housing more compact than provided in previous constructions wherein the depth of the housing plus the rearwardly projecting cores is shorter than the assembly, including the cores, of the former arrangement built in accord with the teachings of U.S. Pat. No. 3,537,197.

It is the object of a facet of the invention to provide a housing mounting such actuable levers where the spacing between each permanent magnet locus and the corresponding, adjacent, core end is more certainly determined than with prior arrangements. Because of this the required characteristics of the current pulse applied to the energizing coil may be more accurately determined, resulting in a reduction of coil size and an improved ratio of the torque exerted on the lever per unit of power to energize the coil, and in the reduction of the risk that the magnetic field from a core will affect a permanent magnet other than that for which the core is provided. In one aspect of the invention, the last-stated object is attained by providing that the core members are premounted in the rear wall of the housing, the forward ends of the core members having a predetermined forward-rearward location relative to the forward surface of the rear wall, and a predetermined location in the directions perpendicular to the viewing direction. Means are then provided for fixing the rear wall in its attachment to the housing in three dimensions relative to the lever loci thus providing accurately for the spacing and direction between the forward core ends and the permanent magnet loci. In the preferred arrangement the cores are premounted on the rear wall (i.e. before assembly of the rear wall to the side walls) of the housing by insertion in apertures or bores in such rear wall and the forward ends of the cores are located substantially flush with the forward surface of the rear wall. This arrangement greatly assists in the accurate location of the forward core ends relative to the permanent magnet loci.

It is an object, related to a preferred aspect of the invention, to provide that the accuracy of the spacing of the forward core ends from the permanent magnet loci is improved, by providing that the energizing coils for each core are mounted rearwardly of the rear wall of the housing. This arangement provides for a very short (preferably nil) forward projection of the cores from the rear wall. This allows the forward ends of the cores (which are attached to the rear wall which is, in turn, anchored securely in the housing) to be more accurately fixed in space than if the coil were located forwardly of the core mounting. This assists in the accurate spacing of the core ends from the corresponding permanent magnet loci.

It is an object of a preferred aspect of the invention to provide for the accurate spacing of the forward core ends from the corresponding permanent magnet loci by providing an accurate mounting for the levers on which the permanent magnets are mounted. This is effected by mounting the levers on a frame and providing that the frame is inserted in the rear of the housing (absent the rear wall) to a forward location determined by stops. The housing is, in addition, provided with step members which, when the frame has reached its requisite forward location, move into place to prevent rearward removal thus positively determining that the frame has reached its required forward location relative to the frame and retaining it in such location. Thus means are provided for accurately fixing the frame and hence the permanent magnet loci in three dimensions relative to the housing.

It is an object of the invention to provide a lever operated display or indicating mechanism wherein the coils may be wound by automatic machinery. This is achieved in a preferred aspect of the invention by providing that the magnets in the median position of the lever are rearwardly disposed from the pivot axis and are centred relative to the corresponding forward core ends. With this relationship the core ends may be more widely spaced in a housing of predetermined length and width than with the sideways projecting magnets of former arrangements. This allows the lever elements and hence the corresponding cores to be more widely spaced relative to each other than with the former arrangements. The core extents project rearwardly from the rear wall of the housing. Because of such rear projection and such increased spacing, a multiple winding head, having the same member of heads as there are cores may be pre-wound (i.e. before the wall is attached to the remainder of the housing), in a single winding operation, the cores projecting rearwardly from such rear wall. After such pre-winding, the rear walls with the pre-wound coils may be simply attached to the housing. These procedures, available with the new construction, greatly reduce the cost of the construction of the device.

The reduction in coil size permitted by the inventive design provides three important advantages. Firstly the coil (and hence the core) may be made shorter resulting in the whole device being smaller in the forward-rearward or in the viewing direction. Secondly the coil is of smaller diameter leaving more space thereabout for winding. Thirdly, fewer turns are required.

Other advantages and objects of the invention will be apparent from the preferred embodiment to be described.

In drawings which illustrate a preferred embodiment of the invention:

Figure 1:
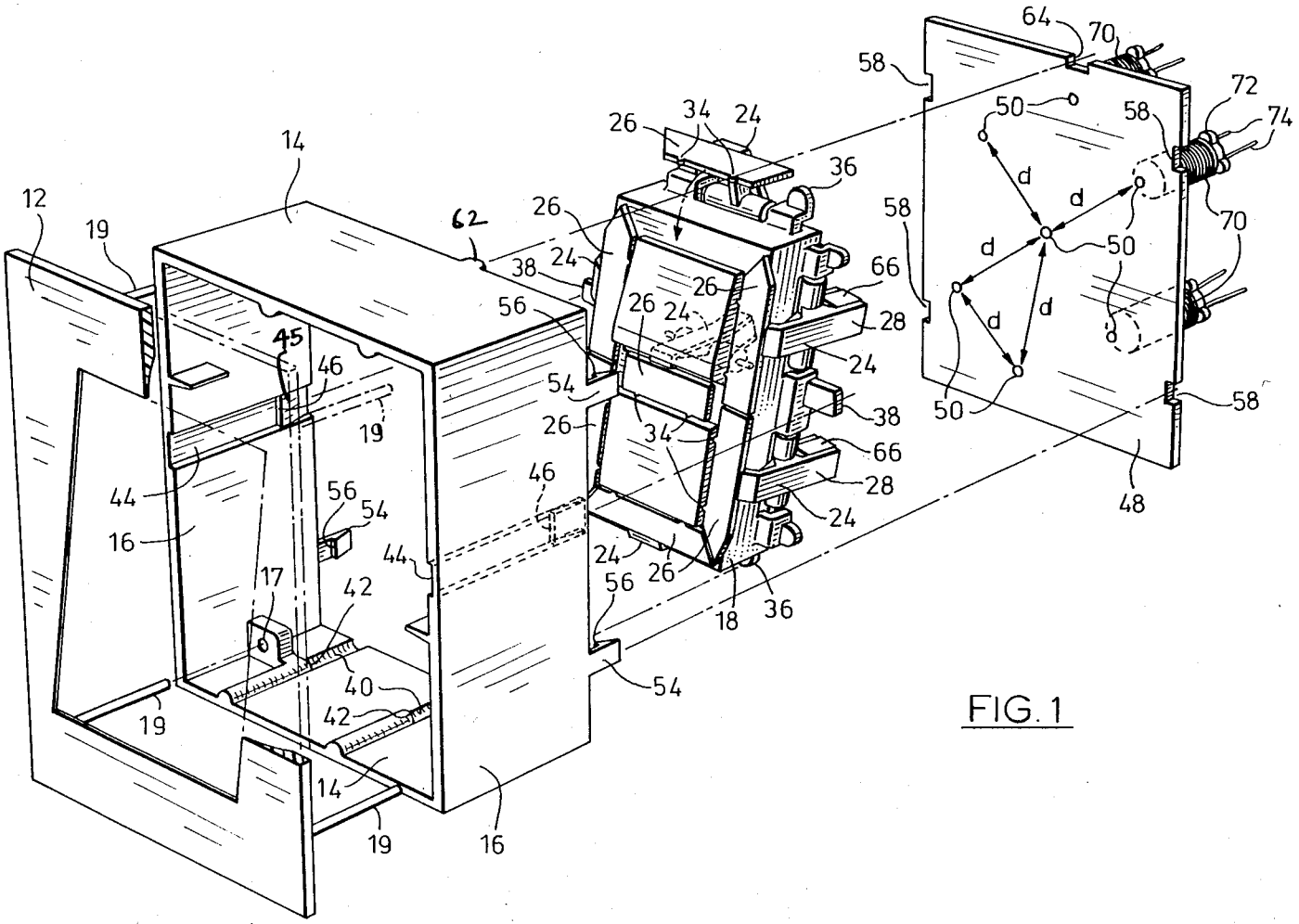
FIG. 1 is an exploded perspective view of the device viewed from the front.

In the drawings a housing of rectilinear shape defines a front wall 12 with a side wall assembly extending rearwardly therefrom. The side wall assembly defines a rectilinear housing shape comprises narrower upper and lower walls 14 and longer side walls 16. The front wall 12 is provided with a parallelogram shaped aperture through which the selectable bar elements to be described will be visible. Thus the front wall of the housing faces in what will be described as the viewing direction.

The front wall 12, side wall assembly 14, 16, frame 18 and rear wall 48, are each molded plastic parts and the design thereof, in many facets, is arranged for the convenient and efficient production combination and assembly of these molded parts.

As shown, the housing front wall 12 is molded separately from the side wall assembly comprising walls 14 and 16. The side wall assembly comprising walls 14 and 16 has molded therein abutments with bores 17 directed in the forward-rearward direction at the inside of each of the four corners of the side wall assembly. The front wall 12 is provided with four rearwardly directed posts 19 shaped and located to be received in bores 17. Although adhesive could be used to retain posts 19 in bores 17 when the front wall is closed up to the side walls, the resiliency and friction of the plastic molded parts is usually found sufficient to retain the front wall as the side wall assembly. The construction of the front wall 12 as a separately molded member from the side wall assembly provides a significant advance over the construction of these members as a single molded part in previous arrangements. Particularly, the new construction allows the molding of the various coupling surfaces of side wall assembly with more freedom of choice and less expense. Other means than posts 19 are considered within the scope of the invention for attaching a separate front wall to a separate side wall assembly.

Figure 2:
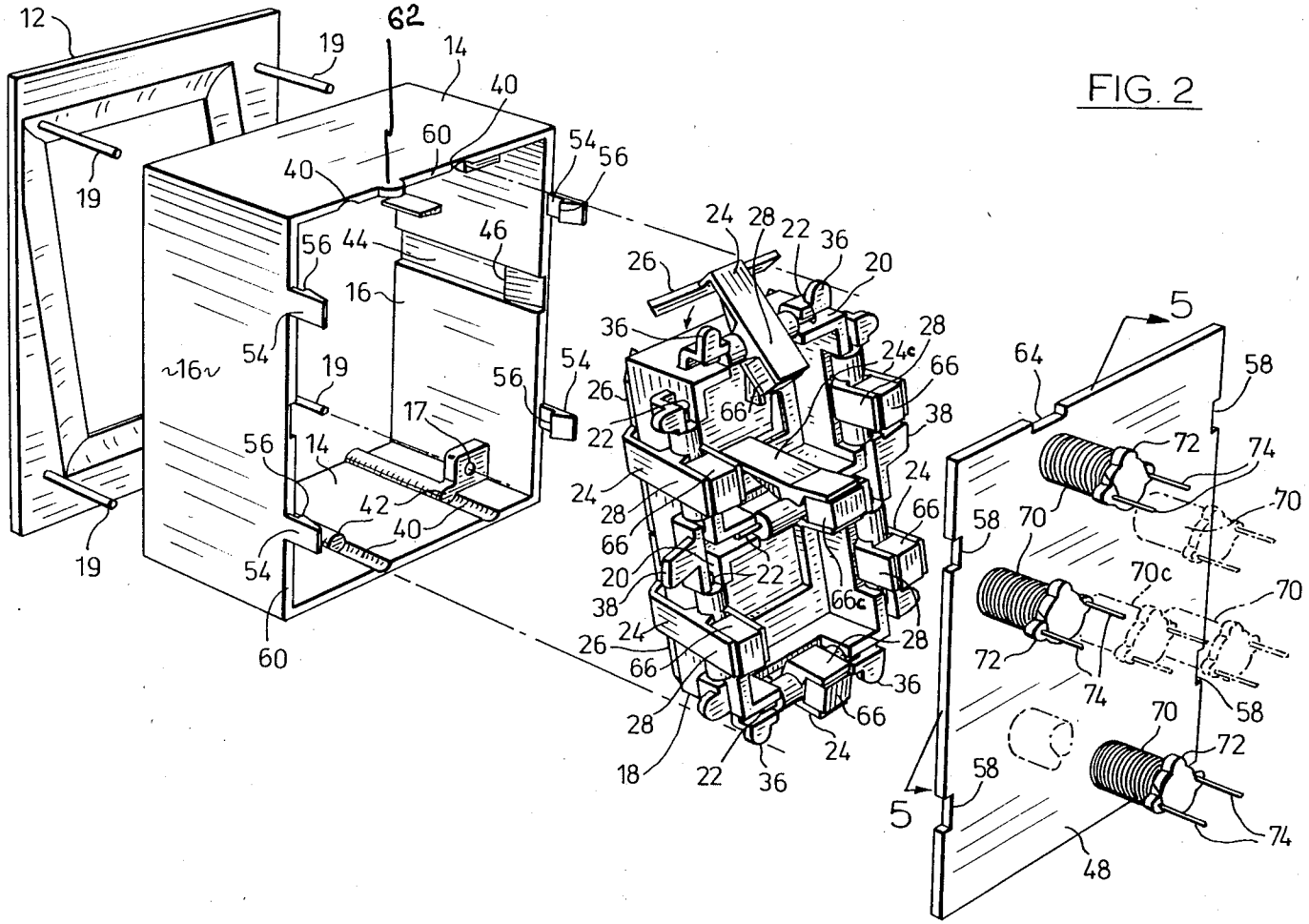
FIG. 2 is an exploded perspective view of the device viewed from the rear.

A frame 18 is designed to mount the lever elements. As illustrated in FIG. 2, the frame 18 defines two longitudinal and three transverse rearwardly facing grooves 20 into which the pivot shafts 22 for the seven lever elements may be attached. The pivot shafts 22 and the groove defining portions of the frame (the latter being preferably formed of molded plastic) are formed so that the shafts may be simply clipped into the grooves 20 to be held by the resiliency of the groove defining members. (If desired small projection 23 may be provided in the grooves to aid in such retention). Mounted on the shafts 22 are the lever elements 24 designed to pivot easily thereon while extending forwardly and rearwardly therefrom relative to the frame 18. The frame 18, including its groove defining portions is recessed, as shown, to allow free pivotting of the levers on the pivot shafts 22 over the desired range of movement as hereinafter defined. The end of each lever 24 located forwardly of the pivot pin mounts a blade 26 of relatively thin cross section measured radially from the corresponding pivot shaft.

The thin blade 26 displays in its two wider dimensions a bar extending longitudinally on each side of the lever 24 parallel to the lever pivot axis and having one of its side edges attached (preferably integrally) to the lever 24 to extend in its lateral dimension from the lever approximately perpendicularly to the radius from the corresponding pivot shaft 22. The outer surface of the blade is coloured (here white) to contrast with the background which is that part of the stationary portion of the frame (here black) which is seen through the aperture. Rearwardly of the pivot shaft 22 the lever defines spaced rearwardly projecting members 28 spaced to receive a permanent magnet 66 between them.

The magnet 66 may be retained in place frictionally or by adhesive. The magnet 66 is located relative to the pivot point to counterbalance (but not exactly) the gravitational moment of the blade and arm. The lever 24 is designed to move between two limiting positions. The mechanical limits defining these positions may be provided in a large number of ways. However, in the preferred embodiment (considering all levers 24 except lever 24*c* located at the centre cross bar), the levers 24 have one limiting position determined when the lever 24 adjacent the blade 26 extension strikes the side wall 16 of the housing (e.g. 'k' of FIG. 3) and the other limiting position determined when the outer edge of the blade strikes an abutment on the frame e.g. 'm' of FIG. 3. (The leading edge of each blade 26 is preferably provided with narrow projections 34 to provide for a narrower area of contact with the abutment face). An analogous arrangement is provided for the central lever 24*c*. With the central lever 24*c* the frame, as shown provides abutments to define both limiting positions. The blades 26 and levers 24 together with the frame and front wall aperture are designed so that in the limiting position determined by the housing (or the frame for the dotted position of lever 24*c*) the blade is hidden in the viewing direction by a portion of the front wall 12, (or by a portion 25 of the frame for blade 26*c*), while in the viewing direction the contrasting surface of each blade 26 is displayed through the front wall aperture. The central lever 24*c* differs from the other levers in that it moves from visible to hidden position through a slot in the frame itself, and the limit for its hidden limiting position is supplied by the frame itself. It will be noted that by proper selection of the blades which are to be displayed any number from 0 to 9 may be provided by the seven blades provided. As described so far, the display elements conform roughly to those shown in prior U.S. Pat. No. 3,537,197. In prior devices made in accord with U.S. Pat. No. 3,537,197 the magnets were displaced laterally from the pivot shaft as shown in FIG. 2 of that patent, instead of being displaced rearwardly from the pivot shaft 22 in accord with the arrangement of the present invention.

The frame 18 as just described is located in and assembled to the housing as now described. The frame 18 is provided with a plurality of outwardly extending fingers (here six) on preferably four but at least on two opposite sides of the device. Two fingers 36 project upward and two fingers 36 project downwardly from the frame and on each side a finger 38 projects outwardly. Grooves 40 complementary to the finger 36 ends are formed in the end walls of the housing to receive the ends of the fingers 36. Stops 42 are provided in such grooves which fix the limit of the forward movement of the frame 18 into the housing.

In each side wall 16 a groove 44 is formed which is complementary to the tips of fingers 38. The inner defining surface of groove 44 includes a surface 45, bevelled to slope inwards for inward travel of the fingers therealong. The inward end of the bevel ends with forwardly facing step 46 and this step 46, together with the limited resiliency of the plastic of the housing side walls causes the step 46 to be biased outward by fingers 38 during inward passage of the latter, but after passage by the fingers 38 to spring inwardly to act as a retainer limiting outward movement of the frame when the corresponding fingers have passed thereover. Thus the steps 46 limit outward movement of the frame 18 relative to the housing. The steps 46 are so located to snap into place to retain the fingers 38 at the time that the fingers 36 have contacted the stops 42. Thus the operation of the stops 42 and the steps 46 and the fingers 36 and 38 assures that the frame 18 is accurately positioned in a forward and rearward position relative to the housing which in turn ensures that the position of the loci of the magnets 66 is fixed in a forward-rearward direction relative to the side wall assembly and the housing. The frame and magnet loci are of couse also fixed in the transverse directions by the contact between the housing walls 14 and 16 and the fingers 36 and 38.

Figure 3:
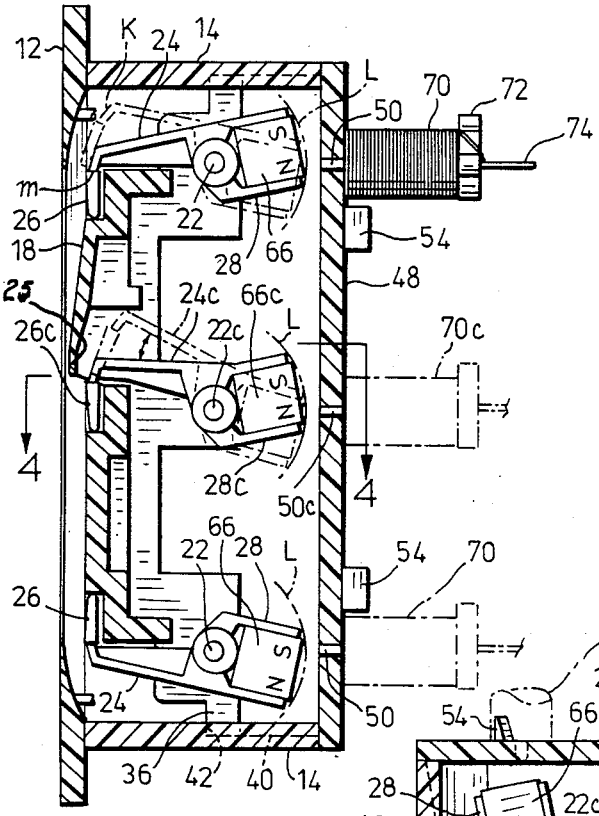
FIG. 3 is a vertical section through the median vertical on a plane parallel to the viewing direction.
Figure 4:
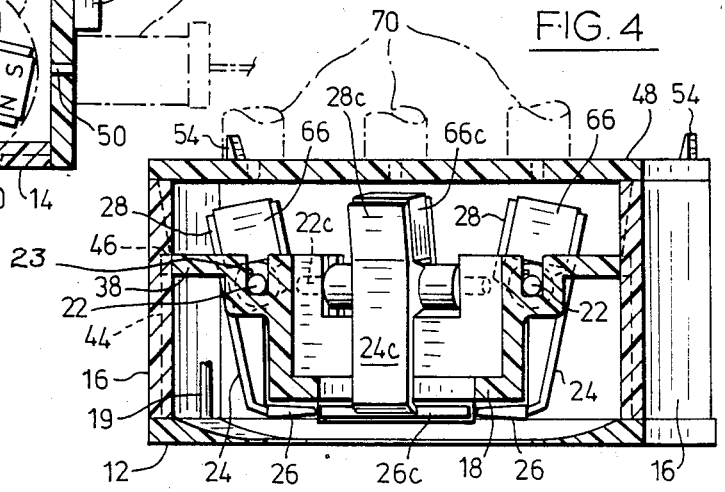
FIG. 4 is a partial section along the line 4—4 of FIG. 3.

A rectilinear rear wall 48 is provided for substantially closing the rear housing and is assembled to the cores 50 which actuate the permanent magnets. The rear wall (with cores and pre wound coils 70 as hereinafter described) is attached to the side wall assembly as now described. Two pairs of opposed probes 54 extend rearwardly from the rear edges of side walls 16. Such probes 54 on their inner surfaces are bevelled to slope inwardly forwardly on their inner surfaces and the forward end of such bevels terminates in a forwardly facing step 56. The side edges of the rear wall are recessed at 58 to receive the inner surfaces of probes 54 and deflect them slightly outwardly to snap in and be retained by steps 56. The rear wall 48 is retained in place by the steps when the rear wall is in position bearing on rear edges 60 of the side wall assembly. It will be noted that the probes 54 then position the rear wall 48 in both lateral dimensions while the rear edges 60 of the side wall assembly together with the steps 56 position the rear wall 48 in a forward-rearward direction. This will be seen to provide the basis for accurately positioning the forward ends of cores 50 relative to the permanent magnet loci. The permanent magnet loci are indicated in FIG. 3 as dotted arcs 'L' and represent the space swept by the permanent magnets 66 in moving between limiting positions.

It will be noted that a rearward projection 62 is provided on one of the side wall assembly rear edges and that a corresponding recess 64 is provided in the corresponding edge of the rear wall. This ensures that the rear wall can be applied to the housing in only one orientation.

Figure 5:
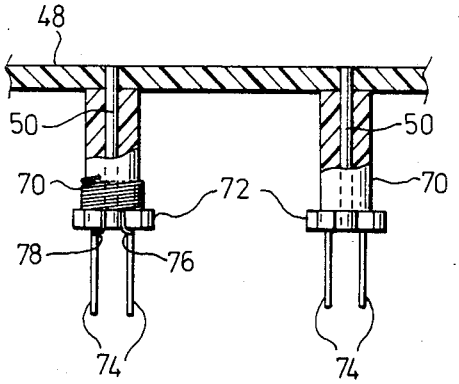
FIG. 5 is a partial section along the line 5—5 of FIG. 2.

Cores 50 of reversible permanently magnetizable (or high remanence) material are provided, mounted on the rear wall 48. Apertures (here 7) are provided in rear wall 48 corresponding to each core. The cores 50 are inserted in the apertures so that their forward ends are flush with the forward surface of the rear wall (see FIG. 5). They are there retained by friction fit, adhesive or in any other desired manner. The apertures and cores 50 are located so that with the rear wall fixed in place the forward end of each core is forwardly and rearwardly aligned with the median position of the magnet (see FIG. 3). Each permanent magnet 66 is magnetized (indicated by 'N' & 'S' in FIG. 3) so that in its median position the magnetic axis N-S is perpendicular both to the forward and rearward direction and to the pivotal axis 22 for the lever 24. The limiting positions of each lever 24 are selected together with the arrangement of the corresponding magnet 66 and core 50 locations so that the core 50 will exert only one direction of torque on the magnet in its travel between two limiting positions. Thus with magnet **66*c* in the position shown in solid line in FIG. 3, it will be retained by the core 50*c* in that position and if deflected by wind or vibration will return to this position. When the polarity of the core is switched by pulsing winding 70*c* the magnet field provided by the core will be reversed and will exert torque on the magnet tending to move it to the other limiting position shown dotted for lever 24*c* over the entire loci. The core 50*c* will then retain the magnet in the dotted limiting position or if the lever 24*c*** deflected will return it to the dotted limiting position.

The cores 50, so mounted in the rear wall mount energizing coils 70. A plastic fitting 72 is providing on the rearward end of the core and mounts the contact probes 74 for connection to the energizing circuitry. An energizing coil 70 is wound on core 50 between the rear wall 48 and the probe fitting 72. The coil winding may be commenced, with automatic winding machinery, by a wire connected to one probe at 76 and then wound back and forth along the probe (the wire will be insulated) until the wound coil end is brought for attachment at 78 to the other probe.

Because the cores 50 project rearwardly from the rear wall 48 (instead of forwardly as formerly) the coils 70 may be pre-wound while assembled to the rear wall 48, and before assembly to the housing side wall assembly, by automatic machinery. Because of the added spacing provided by displacing the magnets 66 rearwardly instead of laterally relative to the respective pivot shafts 22, the spacing between the cores is increased to an amount sufficient to allow the presence of automatic operating winding nipples therebetween. Such increased spacing is indicated by the dimensions "d" in FIG. 1 shown as examples of spacing intervals which are greater in the design than on prior designs. Thus for the seven cores 50 an automatic winding head carrying seven winding nipples may be inserted between the cores and the seven coils 70 wound simultaneously with a great saving in labour and expense. Since the coils 70 may be wound, in situ, on the rear wall 48 the total coil core assembly takes up less space in the forward-rearward direction than if the coils had to be wound separately. Thus the entire assembly (i.e. including the coils) is shortened in the forward-rearward direction.

Because the cores 70 are mounted in the rear wall adjacent their forward ends, much more certainty is achieved in their location both forward and rearward and transversely relative to the magnet locus L than with the former construction which mounted the cores and coils projecting forwardly from a rear wall.

Because the cores 70 are mounted projecting rearwardly from the rear wall, the housing may be substantially completely covered by the rear wall 48 and the levers, pivots and blades protected from dust, other contamination and air currents. Prior construction provided open access to the levers, pivots and blades between the side walls and the rear wall.

Because there is little or nil projection of cores 70 forwardly from their support the forward end of cores 70 is more accurately fixed relative to locus L than prior arrangements.

In view of the fact that the spacing of the cores from the magnet loci may be more accurately determined, and in view of the fact that the lever balance and magnet arrangement provides for lower (average) lever torque, both the coil size and the number of turns thereon may be reduced.

The reduction in the coil length in a forward rearward direction, has been approximately 30% compared to devices manufactured in accord with the former patent has significantly reduced the overall depth of the device in the forward-rearward direction. Reduction in the number of turns has reduced both material cost and winding time. Reduction in coil diameter has left more space between the coils of an array (exemplified by the dimension d in FIG. 1) for the operation of the automatic winding heads referred to at page 13, line 2 et seq.

I claim:

1. A display device comprising:

a housing comprising a front wall facing a viewing direction, a side wall assembly extending rearwardly therefrom, an opening in the front wall of said housing, a plurality of pivotal elements pivotally mounted in said housing, each element comprising:

a lever arm extending generally forwardly and rearwardly from said pivot point, a relatively thin member mounted adjacent the forward end of the lever with its thin dimension approximately radially oriented relative to the pivotal axis, and attached adjacent one edge thereof to the lever, means mounted on said pivotal element holding a magnet on the opposite side of said pivot point from said thin member, said pivotal elements being mounted in said housing to mvoe between two limiting positions, one limiting position corresponding to the display of said thin member in said aperture and there being, when said pivotally mounted element is in said other limiting position, means associated with said housing for eclipsing said thin element, in the viewing direction, said thin member being coloured to contrast with the background of the opening when viewed in said viewing direction, said magnet being magnetized to define a magnetic axis roughly perpendicular to the radius from said pivot axis and in a plane having a component perpendicular to said pivot axis, a rear wall for said housing releasably attached to said side walls by a resilient deflectable connection located to be spaced rearwardly from but adjacent to the locus of magnet movement, an aperture in said rear wall corresponding to each magnet, a reversible permanently magnetizable core mounted in a corresponding aperture in said rear wall, the forward end of each said core being adjacent to and a predetermined distance from the forward surface of said rear wall, said core extending rearwardly from said rear wall, an energizing coil mounted on each said core, means for fixedly locating said rear wall relative to said side wall assembly and said magnets, each said core when so located in the corresponding aperture being designed when polarized in one sense to exert a force on the corresponding permanent magnet over its entire range of movement between limiting positions, and when polarized in the other sense to exert a force in the opposite sense on the corresponding permanent magnet over its entire range of movement between limiting positions.

2. In a display or indicating device comprising:

a housing having front side and releasably attachable rear walls relative to a viewing direction, defining a forward-rearward direction, a forward aperture in said housing, a plurality of pivotally mounted elements mounted in said housing movable between two limiting positions, said elements in their median positions between said limiting positions, projecting approximately forwardly and rearwardly from their pivot points, a display surface mounted adjacent the forward end of each of said display elements, each said display surface being oriented to be displayed in said apertured in one of the limiting positions of the corresponding element, means for eclipsing, in the viewing direction, each of said display surfaces in the other of the limiting positions of the corresponding element, a permanent magnet mounted adjacent the rear of each of said pivotally mounted elements, said magnet, in said median position defining a magnetic axis running approximately perpendicular to said forward-rearward direction, a magnetic core member of reversibly permanently magnetizable material corresponding to each of said movable elements each said core member having a forward end located when magnetized in one and in the opposite sense to cause the corresponding element through its permanent magnet to move between said limiting positions in one and the other direction respectively, an energizing coil for each of said core members, wherein said core members are mounted in said rear wall member, wherein said core members project rearwardly from said core members and said energizing coils are mounted on said respective core members, rearward of said rear wall, wherein a frame is provided for pivotally mounting said rotatable elements, means are provided for guiding said frame forwardly into said housing when said rear wall is absent, stops are provided in said housing for stopping the forward movement of said frame at the desired location therefor and releasable step means are provided designed to move into position to retain said frame in place when said desired location is reached.

3. A display device comprising:

a housing comprising a front wall facing a viewing direction, a side wall assembly extending rearwardly therefrom, an opening in the front wall of said housing, a plurality of pivotal elements pivotally mounted in said housing, each element comprising:

a lever arm extending generally forwardly and rearwardly from said pivot point, a relatively thin member mounted adjacent the forward end of the lever with its thin dimension approximately radially oriented relative to the pivotal axis, and attached adjacent one edge thereof to the lever, means mounted on said pivotal element holding a magnet on the opposite side of said pivot point from said thin member, said pivotal elements being mounted in said housing to move between two limiting positions, one limiting position corresponding to the display of said thin mmeber in said aperture and there being, when said pivotally mounted element is in said other limiting position, means associated with said housing for eclipsing said thin element, in the viewing direction, said thin member being coloured to contrast with the background of the opening when viewed in said viewing direction, said magnet being magnetized to define a magnetic axis roughly perpendicular to the radius from said pivot axis and in a plane having a component perpendicular to said pivot axis, a rear wall for said housing releasably attached to said side walls located to be spaced rearwardly from but adjacent the locus of magnet movement, an aperture in said rear wall corresponding to each magnet, a reversible permanently magnetizable core mounted in a corresponding aperture in said rear wall, the forward end of each said core being adjacent to and a predetermined distance from the forward surface of said rear wall, said core extending rearwardly from said rear wall, an energizing coil mounted on each said core, means for fixedly locating said rear wall relative to said side wall assembly and said magnets, each said core when so located in the corresponding aperture being designed when polarized in one sense to exert a force on the corresponding permanent magnet over its entire range of movement between limiting positions, and when polarized in the other sense to exert a force in the opposite sense on the corresponding permanent magnet over its entire range of movement between limiting positions, where the forward ends of each of said cores is substantially flush with the forward surface of said rear wall.

* * * * *